United States Patent [19]

Freedman et al.

[11] 4,282,609

[45] Aug. 11, 1981

[54] APPEARANCE MODIFYING PANTY HOSE

[75] Inventors: Betty Freedman; Anne M. Blevins, both of New York, N.Y.

[73] Assignee: Concepts for Women, Inc., New York, N.Y.

[21] Appl. No.: 844,530

[22] Filed: Oct. 25, 1977

[51] Int. Cl.[3] ..... A41B 11/00; A43B 17/00

[52] U.S. Cl. ..... 2/239; 66/180

[58] Field of Search ..... 2/239, 409; 66/177, 66/178, 180; D2/229, 7, 336, 337, 341, 342

[56] References Cited

U.S. PATENT DOCUMENTS

| | | | |
|---|---|---|---|
| D. 62,924 | 2/1923 | Stewart | 66/180 X |
| D. 63,272 | 11/1923 | Schletter | 66/180 X |
| D. 82,080 | 9/1930 | Martinez | 2/337 |
| D. 161,480 | 1/1951 | Magnier | 2/341 |
| D. 167,236 | 7/1952 | Stillman | 2/341 |
| D. 167,322 | 7/1952 | Schletter | 2/341 |
| D. 171,876 | 4/1954 | Apar | 2/342 |
| D. 171,951 | 4/1954 | Nolan | 2/337 |
| 1,654,064 | 12/1927 | Zaki | 2/239 |
| 1,817,053 | 8/1931 | Zerk | 2/239 |
| 1,852,138 | 4/1932 | Zerk | 2/239 |
| 3,128,475 | 4/1964 | Rice et al. | 66/177 X |

FOREIGN PATENT DOCUMENTS

| | | | |
|---|---|---|---|
| 1357782 | 3/1964 | France | 2/409 |
| 1463210 | 11/1966 | France | 2/239 |
| 1569583 | 4/1969 | France | 2/239 |
| 1266927 | 3/1972 | United Kingdom | 2/409 |

*Primary Examiner*—Ronald Feldbaum

*Attorney, Agent, or Firm*—Marvin Feldman; Stephen E. Feldman

[57] ABSTRACT

Panty hose is provided with adjacent shaded areas with gradations in shading, in the calf portion, whereby when the panty hose is worn the appearance of the shape of the leg is modified. In one embodiment, legs with heavy calves and thighs are given a slimming appearance, and in another embodiment, skinny, shapeless legs are given a fuller appearance. The shaded areas may be printed directly on the hose by heat transfer paper printing.

13 Claims, 6 Drawing Figures

APPEARANCE MODIFYING PANTY HOSE

FIELD OF THE INVENTION

This invention relates to an improvement in garments. Specifically, this invention relates to panty hose which provides a shape modifying appearance to the legs of the wearer.

DESCRIPTION OF THE PRIOR ART

Heretofore it was known to color a pair of stockings in different colors to achieve a decorative effect. In Blore, U.S. Pat. No. 3,701,164, the heel and toe portions were differently colored from the entire leg portion; and in British Pat. No. 1,266,927, the upper and lower leg portions were differently colored; and in French Pat. Nos. 1,357,782 and 2,267,714 various designs were provided on leg garments.

In Lewis, U.S. Pat. No. 3,683,419, a decorative design was provided on undergarments, which design provided a changing moire pattern with movement.

While the prior art provided decorative and amusing patterns on leg garments, the prior art garments did not provide a change in the appearance of the leg shape.

Now there is provided by the present invention an article of wearing apparel which when worn gives a more aesthetically pleasing shape to a portion of the body of the wearer.

It is therefore a principal object of this invention to provide an article of wearing apparel which when worn provides the appearance of a change in shape to a portion of the body of the wearer.

It is another object of this invention to provide an article of wearing apparel as immediately aforesaid wherein the article is panty hose.

It is a further object of this invention to provide hose which alters the appearance of heavy legs to appear to be thinner and more shapely.

It is a further object of this invention to provide hose which alters the appearance of skinny legs to appear to be fuller and more shapely.

It is still a further object of this invention to provide panty hose which may readily be imprinted with a shading configuration specifically suited to the base color of the hose, to provide a more aesthetically appealing leg shape to the wearer.

Figure 1C:
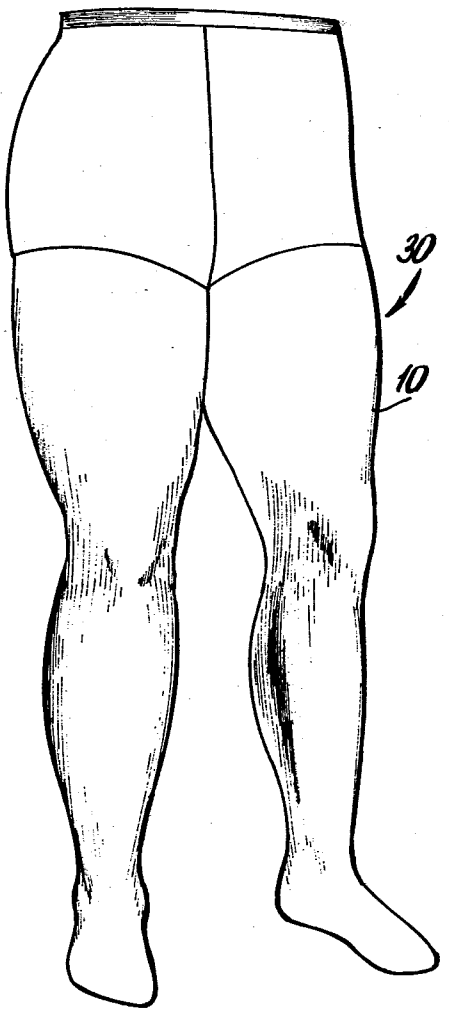
Figure 1B:
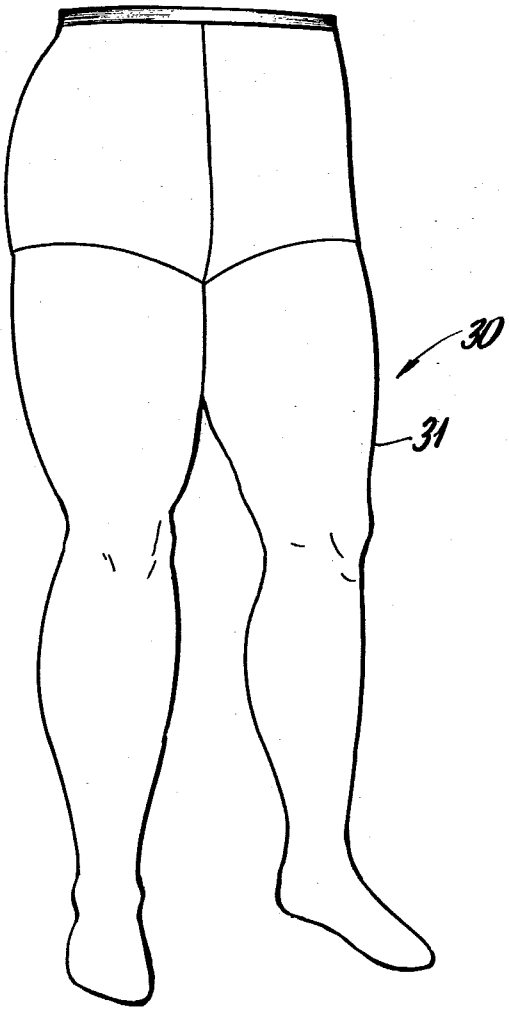
Figure 1A:
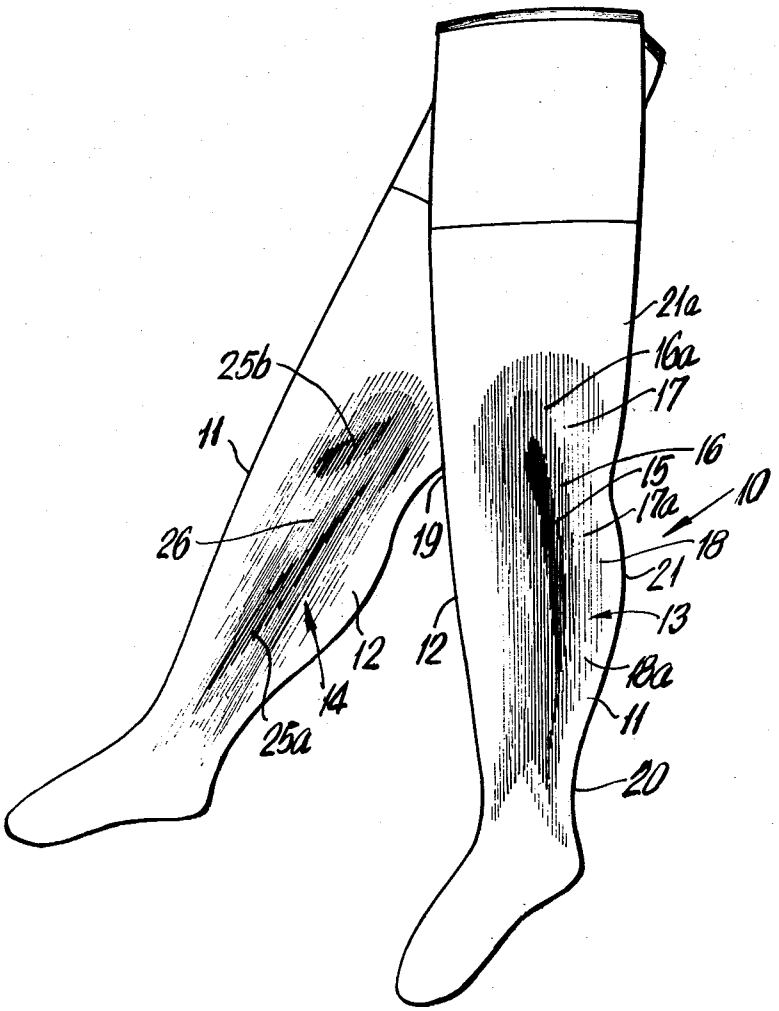

The aforesaid as well as other objects and advantages as will be made apparent from a reading of this specification, the adjoined claims, and the accompanying drawings in which:

FIG. 1*a* is a side view of the panty hose of this invention for a heavy-legged person;

FIG. 1*b* is a front perspective view of a pair of conventional panty hose as worn by a heavy-legged person;

FIG. 1*c* is a front perspective view of the hose of FIG. 1*a* as worn by the person depicted in FIG. 1*b;*

Figure 2C:
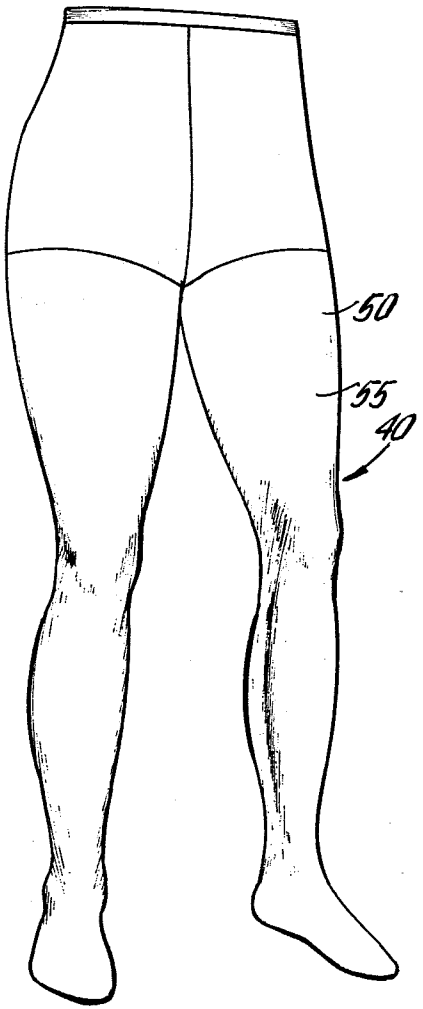
Figure 2B:
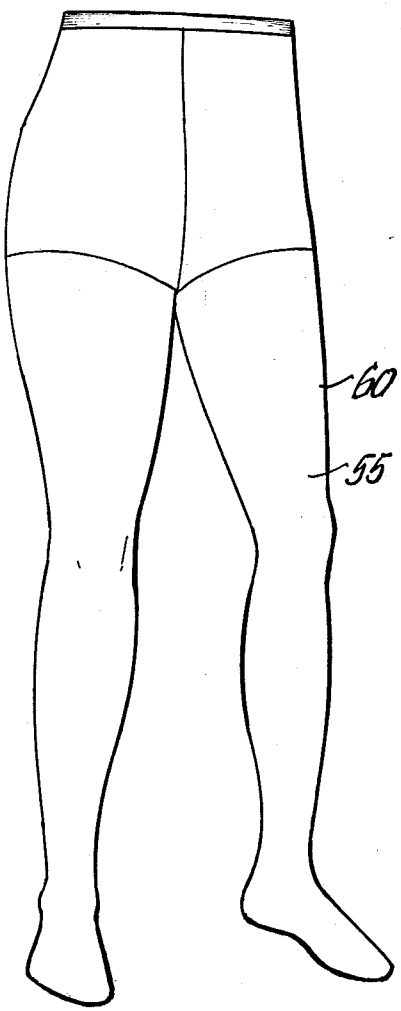
Figure 2A:
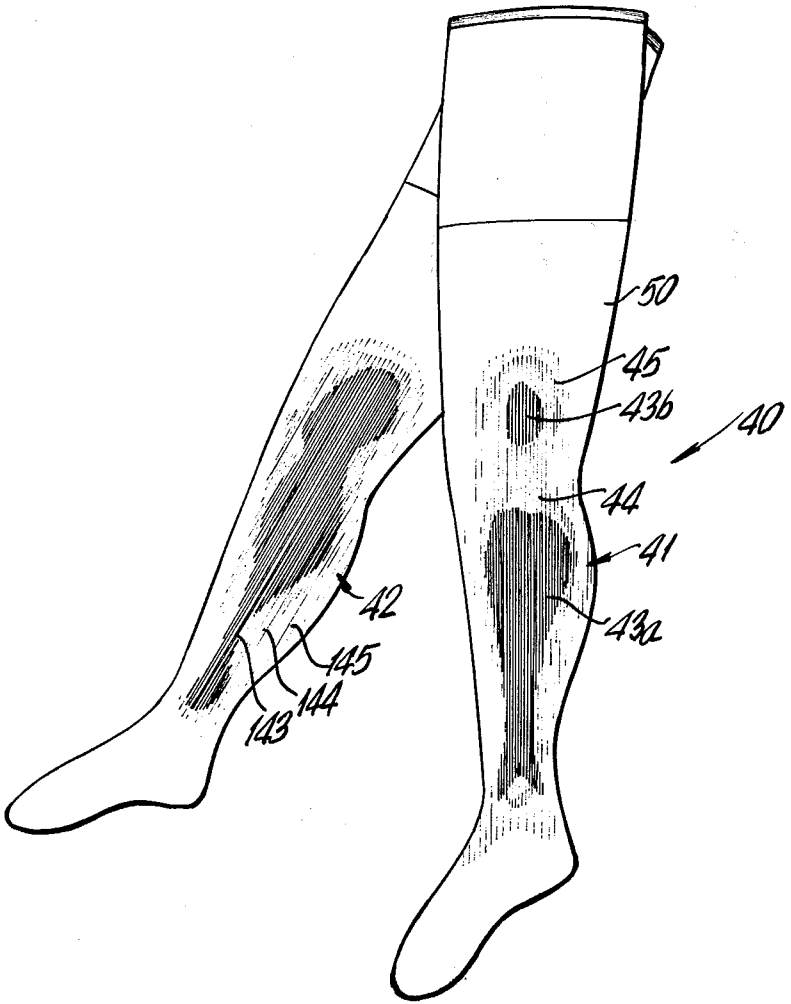

FIG. 2*a* is a side view of the panty hose of this invention for a skinny-legged person;

FIG. 2*b* is a front perspective view of a pair of conventional panty hose as worn by a skinny-legged person; and FIG. 2*c* is a front perspective view of the hose of FIG. 2*a* as worn by the person depicted in FIG. 2*b*.

Broadly speaking, the present invention comprises an article of wearing apparel formed so as to closely fit the body and having gradations of shading in a portion of the apparel, whereby the apparel when worn provides an appearance modifying shape at said portion. In another aspect, the present invention comprises a pair of panty hose having gradations of shading in the calf regions so as to provide an appearance modifying shape to the legs.

It has been found that where gradations of shading are imprinted on a contour fitting garment, there is provided a shape modifying appearance to that portion of the body subject to the contour fit. Specifically, it has been found that panty hose having a well-known commercially available base color, when imprinted in the calf region with adjacent areas of gradated shadings or hues of the base color, a shape modifying appearance to leg is provided.

By the term "gradations in shading" it is meant that there is a deepening or increasing in intensity of a certain hue. That is to say, the base color comprises three component colors which are generally variations of the primary colors, to wit, red, yellow and blue. The "gradations of shading" would then be a change (i.e. increase or decrease) in the amount of one of the component colors from one area of the imprinted portion to the adjacent area.

Specifically, it has been found that to modify the appearance of a thick-calved leg so as to appear slimmer and more shapely, the panty hose is provided with gradations in shading in the calf region extending radially outwardly from the side of the calf with a gradual decrease of the color in the blue end of the spectrum, and perhaps to some degree an increase of the color in the red end of the spectrum.

Conversely it has been found, that to modify the appearance of a skinny-leg to appear fuller and more shapely, the panty hose is provided with gradations in shading in the calf region extending radially outwardly from the side of the calf, with a gradual decrease in the blue end spectrum component color, and a gradual increase in the red end spectrum component color.

The shaded regions are annularly-shaped regions, circumscribing a central region, where the central region generally always exhibits more overall color or hue than the surrounding regions including the base color of the panty hose. This is true for both the heavy-legged version as well as the skinny-legged version. Otherwise worded, the overall hue decreases in the direction radially outwardly from the central shaded area.

It is of course understood that the shaded areas are color-coordinated with the base color of the imprinted panty hose. Each shaded area comprises essentially the same component colors as the base color but in differing amounts according to the above teaching.

Referring to FIG. 1*a* there is shown a panty hose 10 which is an embodiment of the present invention particularly suited to heavy-legged persons, particularly ones with heavy calves and thighs. One each of the outer surfaces 11 and inner surfaces 12 are shown. An imprinted region 13 is shown on surface 11 and an imprinted region 14 is shown on surface 12; with the outer and inner surfaces not shown having corresponding imprinted regions.

Region 13 comprises four printed areas, namely 15, 16, 17 and 18. Area 15 is a central elongated area extending from about the knee region 19 to the ankle region 20 and being disposed on the side of the calf region 21. Area 15 is the deepest hued or most darkly shaded region. Surrounding area 15 is area 16 which circumscribes area 15 in the forms of an annular region 16*a* of varying thickness; and circumscribing area 16 in area 17 forming annular region 17*a;* and surrounding area 17 is area 18 forming annular region 18*a.* Areas 16, 17 and 18 extend in seriatim radially away from central area 15. The gradations in shading decrease in the radial outward direction from 15 to 18, as will be more fully explained hereinafter.

The variations in hue may be expressed as follows. Panty hose 10 in the leg region 21*a* is of a base color which is comprised of three component colors which are generally variations of the primary colors; red (R), yellow (Y) and blue (B). The variations of hue are effected by increasing (+) or decreasing (−) one or more of the component colors. This is illustrated for panty hose 10 in Table I.

TABLE I

| Area | Component Colors |
|---|---|
| 21a | R, Y, B, (e.g. taupe) |
| 18 | R, −Y, +B |
| 17 | R, Y, +B |
| 16 | −R, −Y, +B |
| 15 | −R, −Y, ++B |

The shading or hue for each shaded area (15–18) is compared with the base color in area 21*a.* As can be readily discerned there is an increase in the amount of component color towards the blue end of the spectrum as one moves radially inwardly from 18 to central area 15.

The inner printed region 14 is and has a similar four area or zone of imprinted shadings as outer region 13 with a principal variation. Region 14 comprises two central deep hued areas 25*a* and 25*b* which are spaced from each other but both areas are commonly surrounded or circumscribed by adjacent area 26.

Referring now to FIGS. 1*b* and 1*c* there is shown a pair of heavy-calved and heavy-thighed legs 30 wearing in FIG. 1*b.* a conventional panty hose 31, and wearing in FIG. 1*c.* the panty hose 10. It is readily discernible that the shaded areas of 10 contour the body and increase in size with the stretching of the fabric in contouring the legs. One effect of the stretching of the area size is to present a more gradual change in shading than appear on the unworn hose. In all the total effect is to provide a slimming appearance to the legs.

It is of course understood that the invention is likewise suitable to other heavy-legged persons where the basic problem is that the legs are heavy and shapeless throughout rather than specifically limited to the calves and thighs. In such case the shaded areas tend to extend almost entirely throughout the lower leg portion on opposing sides of the calves.

Referring now to FIG. 2*a* there is shown another embodiment of the present invention, namely, panty hose 40 which is suited for skinny-legged persons. Panty hose 40 comprises a base colored leg portion 50 having imprinted regions 41 and 42 on the outer and inner surfaces of the panty hose. Region 41 comprises two central areas of deepest hue, 43*a* and 43*b,* surrounded by area 44 and in turn 45, of decreasing shading in the radial outward direction from each of the central areas respectively. Inner surface 42 has three areas 143, 144 and 145 corresponding in hues to 43*a;* 43*b;* 44; and 45 respectively.

The variation in hues for panty hose 40 is illustrated in Table II.

TABLE II

| Area | Component Colors |
|---|---|
| 50 | R, Y, B (e.g. taupe) |
| 45 | −−−R, +Y, −B |
| 44 | −−R, ++Y, −−B |
| 43a, 43b | −R, ++Y, −−−B |

The component colors are compared with the component colors of the base color. That is area 45 has significantly less red than base color 50, while area 44 has not as much red removed from the base red, and areas 43*a,* 43*b* even less so. Thus in the radial inward direction there is an increase in the red component color.

Referring to FIGS. 2*b* and 2*c,* there is shown a pair of skinny-legs 55 wearing in FIG. 2*b* a pair of conventional panty hose 60, and in FIG. 2*c,* said panty hose 40. In FIG. 2*c* there is the appearance of fuller and more shapely legs, while such is not the case in FIG. 2*b.*

While the color schemes of Tables I and II are designed to the color taupe, the color schemes would be similarly applicable to the colors such as tan, sandstone, and the like, and are particularly suited to the several commercially available flesh tones.

In the following Table III, specific commercially available colors are designated for the component colors as applied to the embodiment of FIG. 1*a.:*

TABLE III

| Area (FIG. 1a No.) | Component Colors |
|---|---|
| base hose color (21a) | pale taupe |
| more adjacent central (18) | taupe |
| next more adjacent central area (17) | medium taupe |
| most adjacent central (16) | dusty taupe |
| central area (15) | smokey taupe |

The various component colors may be readily blended and formulated by one skilled in the art, and the blended colors may be imprinted on the hose by well known commercially available methods such as screen printing and heat transfer printing. This invention is particularly suited to heat transfer paper printing, wherein the paper has the particularly shape modified appearance style desired by the user.

Suitable substrate fabrics for imprinting include the well known material and synthetic fabrics, particularly nylon and polyesters, and blends of natural and synthetic fibers.

It should be understood that the figures and the specific description thereof set forth in this application are for the purpose of illustrating the present invention and are not to be construed as limiting the present invention to the precise and detailed specific structure shown in the figures and specifically described hereinbefore. Rather, the real invention is intended to include substantially equivalent constructions embodying the basic teachings and inventive concept of the present invention.

What we claim is:

1. A hose comprising a fabric formed so as to closely fit the leg of the wearer, said fabric having a first shaded area and a second shaded area circumscribing the first shaded area, said shaded areas being differently shaded from each other, and wherein the first shaded area is in the calf region between the front and rear, wherein the first shaded area is on the fabric portion covering the outside of the leg and further comprising a third shaded area, and a fourth shaded area circumscribing the third shaded area, said third and fourth shaded areas being differently shaded from each other, and wherein the third shaded area is in the calf region between the front and rear and being disposed on the portion covering the inside of the leg, and whereas the first area is spacedly disposed from said third area, and wherein said areas are differently contoured along the length of the hose, whereby the combination of areas provides an appearance of modifying the shape to the legs.

2. The article of claim 1, wherein the fabric has a base color which is differently shaded than said shaded areas, said shadded areas comprising red and blue component colors.

3. The article of claim 2, wherein said second shaded area comprises more of the blue component color than said first shaded area, and said first shaded area comprises more of the blue component color than said fabric base color, whereby the panty hose when worn provides a slimmer appearance to the leg.

4. The article of claim 2, wherein said second shaded area comprises more of the red component color than said first shaded area, and said first shaded area comprises more of the red component color than said fabric base color, whereby the panty hose when worn provides a fuller appearance to the leg.

5. The article of claim 3, wherein the second area comprises less red than said first area.

6. The article of claim 4, wherein the second area comprises less blue than said first area.

7. The article of claim 1, wherein the first shaded area is a deeper hue than said second shaded area, and said second area is disposed more rearwardly in the calf region.

8. The article of claim 1, wherein the fabric has a base color which is different from said shaded areas, and wherein the first shaded area is a deeper hue than said second shaded area and said second shaded area is a deeper hue than said base color.

9. Panty hose comprising gradations of shading in the calf regions comprising a first central shaded area, a second shaded area circumscribing said first area, and a third shaded area circumscribing said second area, wherein the gradations of shading extend radially in the calf regions, whereby the panty hose when worn provides an appearance modifying shape to the legs, wherein the gradations in the radial inward direction provide more towards the spectral red region, so that the panty hose when worn provides a fuller appearance to the legs.

10. The panty hose of claim 9, wherein the panty hose fabric comprises a base color comprising component colors, and wherein said gradations of shading comprise varying amounts of said component colors.

11. The panty hose of claim 9, further comprising a second central shaded area spaced from the first central shaded area and said second shaded area circumscribing said central areas.

12. The panty hose of claim 8, wherein the gradation of shading are imprinted on the panty hose, and the shadings are color-coordinated with the color of the unprinted panty hose.

13. Panty hose comprising gradations of shading in the calf regions comprising a first central shaded area, a second shaded area circumscribing said first area, and a third shaded area circumscribing said second area, wherein the gradations of shading extend radially in the calf region, whereby the panty hose when worn provides an appearance modifying shape to the legs, wherein the gradations in the radial inward direction provide more towards the spectural blue region, so that the panty hose when worn provides a slimmer appearance to the legs.

* * * * *